US008028993B2

(12) United States Patent
Witty

(10) Patent No.: US 8,028,993 B2
(45) Date of Patent: Oct. 4, 2011

(54) ROULETTE WHEEL

(75) Inventor: Simon Witty, Sydney (AU)

(73) Assignee: TCS John Huxley Europe Limited (GB)

( * ) Notice: Subject to any disclaimer, the term of this patent is extended or adjusted under 35 U.S.C. 154(b) by 403 days.

(21) Appl. No.: 11/991,993

(22) PCT Filed: Sep. 7, 2006

(86) PCT No.: PCT/GB2006/003314

§ 371 (c)(1),
(2), (4) Date: Feb. 27, 2009

(87) PCT Pub. No.: WO2007/031714

PCT Pub. Date: Mar. 22, 2007

(65) Prior Publication Data

US 2009/0174141 A1 Jul. 9, 2009

(30) Foreign Application Priority Data

Sep. 13, 2005 (GB) ..... 0518662.2

(51) Int. Cl.
*A63F 5/00* (2006.01)

(52) U.S. Cl. ..... 273/142 E; 273/142 R; 273/274; 463/17

(58) Field of Classification Search ..... 273/142 E, 273/142 R, 142 F, 142 G, 142 H, 142 HA, 273/274; 463/17

See application file for complete search history.

(56) References Cited

U.S. PATENT DOCUMENTS

| | | | | |
|---|---|---|---|---|
| 4,869,505 | A * | 9/1989 | Manabe | 463/22 |
| 5,743,798 | A | 4/1998 | Adams et al. | |
| 5,836,583 | A * | 11/1998 | Towers | 273/142 B |
| 2003/0060263 | A1 | 3/2003 | Pearce et al. | |

FOREIGN PATENT DOCUMENTS

| | | |
|---|---|---|
| EP | 0 194 630 | 9/1986 |
| WO | WO 01/52957 A1 | 7/2001 |
| WO | WO 01/55988 A1 | 8/2001 |
| WO | WO 01/86604 A2 | 11/2001 |

* cited by examiner

*Primary Examiner* — Benjamin Layno

(74) *Attorney, Agent, or Firm* — Brooks, Cameron & Huebsch, PLLC

(57) ABSTRACT

A roulette wheel (1) has a ball detector (9*a*, 9*b*, 9*c*) to detect the ball as the ball travels round the rim (3) of the roulette wheel and a drop determiner (21) to determine, for each of a number of games of roulette, the region of the rim from which the ball fell from the rim. Data representing, for a number of games, the region of the rim from which the ball fell from the rim may then be stored for later analysis or may be directly analysed to determine any drop zone bias. The ball detector may be a number of ball detecting elements (9*a*, 9*b*, 9*c*) spaced apart around the rim (3) of the roulette wheel for each providing a ball detection signal as the ball travels through a corresponding region (R1, R2 and R3) of the rim and the drop detector (21) may determine the region of the rim from which the ball fell from the rim by determining the detecting element passed last by the ball.

30 Claims, 8 Drawing Sheets

23

| 31 Game number | 32 Last detector | 33 Winning number | 34 Rotation |
|---|---|---|---|
| 1 | 1 | 7 | CW |
| 2 | 1 | 25 | CW |
| 3 | 1 | 29 | CCW |
| 4 | 1 | 12 | CW |
| 5 | 1 | 15 | CCW |
| 6 | 1 | 31 | CW |
| 7 | 1 | 32 | CW |
| 8 | 2 | 15 | CW |
| 9 | 3 | 5 | CCW |
| 10 | 3 | 22 | CW |
| 11 | 2 | 1 | CW |
| 12 | 2 | 2 | CCW |
| 13 | 2 | 34 | CW |
| 14 | 2 | 33 | CW |
| 15 | 2 | 5 | CCW |
| 16 | 3 | 16 | CW |
| 17 | 3 | 19 | CCW |
| 18 | 3 | 30 | CCW |
| 19 | 2 | 1 | CW |
| 20 | 3 | 11 | CW |
| 21 | 1 | 7 | CCW |
| 22 | 2 | 20 | CW |
| 23 | 3 | 23 | CCW |
| 24 | 2 | 34 | CW |
| 25 | 1 | 22 | CW |
| . | . | . | . |
| . | . | . | . |
| 1254 | 3 | 10 | CCW |
| 1255 | 3 | 3 | CW |
| 1256 | 2 | 2 | CCW |
| 1257 | 3 | 1 | CW |
| 1258 | 3 | 15 | CW |
| 1259 | 3 | 27 | CW |
| 1260 | 3 | 10 | CCW |
| 1261 | 3 | 4 | CCW |
| 1262 | 2 | 27 | CW |
| 1263 | 1 | 35 | CW |
| 1264 | 2 | 13 | CCW |
| 1265 | 2 | 14 | CW |
| 1266 | 2 | 6 | CCW |
| 1267 | 1 | 29 | CCW |

FIG. 5

ROULETTE WHEEL

This application is a National Stage application under 35 U.S.C. 371 of PCT/GB2006/003314, and published as WO 2007/031714 on Mar. 22, 2007, which claims priority to 0518662.2 filed Sep. 13, 2005.

The present invention relates to a roulette wheel and a method of and a detection system for detecting drop zone bias.

A roulette wheel has a cylindrical support body within which a rotatable pocket cylinder is concentrically mounted so that a circular rim of the support body extends around the rotatable pocket cylinder. During a game of roulette, the pocket cylinder is spun, either by a croupier or by an automatic spinning mechanism, and a ball is set in motion so that it travels around the rim in either the clockwise or counter-clockwise direction. The ball is subjected to forces (for example due to gravity, friction, blasts of air, collisions with decorative features or even movement of the table as a whole) that slow it down until it can no longer travel along the rim and drops into the pocket cylinder, coming to rest in one of the pockets. Players can bet on various characteristics of where the ball comes to rest (for example the particular pocket, the colour of the pocket, whether the pocket number is odd or even, whether the pocket number is in a certain range and so on). The placing of a bet is possible up to just before the ball is about to fall from the rim into the pocket cylinder. The point just before the ball is about to fall into the pocket cylinder is determined by the croupier or an electronic control system providing a "no more bets, please" message.

The roulette wheel should not introduce any bias which affects the fall of the ball from the rim. However, various factors may cause a bias to arise. For example, bias may arise due to manufacturing or installation defects resulting in incorrect levelling, temperature drift, an external change caused by movement of a ship or aircraft where a roulette wheel has been installed, or if a player leans on the roulette table with such force that the roulette wheel is no longer level. When such a bias is present, then part of the path of the ball around the rim may be sufficiently upwardly inclined to cause further slowing of the ball so that the ball consistently drops into the pocket wheel from that part of the rim. Thus if the roulette wheel is not level, then the drop zone of the ball may be biased towards a particular part of the rim. If, by observing a number of games, a player can determine before a game which part of the rim will provide the drop zone for that game then, just before the ball is about to fall into the pocket cylinder, that player can check which part of the pocket cylinder is adjacent that part of the rim and so make a better guess as to the identity of the pocket in which the ball will come to rest. This may allow a player to increase his chances of winning.

STATEMENTS OF INVENTION

An aspect of the present invention provides a method of determining drop zone bias in a roulette wheel.

In an embodiment, a roulette wheel has a ball detector to detect the ball as the ball travels round the rim of the roulette wheel and a drop determiner to determine, for each of a number of games of roulette, the region of the rim from which the ball fell from the rim. Data representing, for a number of games, the region of the rim from which the ball fell from the rim may then be stored for later analysis or may be directly analysed to determine any drop zone bias. The ball detector may be a number of ball detecting elements spaced apart around the rim of the roulette wheel for each providing a ball detection signal as the ball travels through a corresponding region of the rim and the drop determiner may determine the region of the rim from which the ball fell from the rim by determining the ball detecting element passed last by the ball. As another possibility, the ball detector may comprise at least one imaging device, such as a video camera, to provide images of at least the rim of the roulette wheel and the drop determiner may be operable to determine from the image last showing the ball in the rim the region of the rim from which the ball fell from the rim.

In an embodiment, the present invention provides a detection system for detecting drop zone bias in a roulette gaming table having a roulette wheel with a rim, the system comprising: a plurality of ball detecting elements spaced around the rim and each operable to provide a ball detection signal in response to detection of the ball travelling through a corresponding region of the rim; a drop determiner operable to process the ball detection signals to identify, for each of a number of games of roulette, the ball detecting element that detected the ball last before the ball fell from the rim; a memory operable to store, for each of a number of games of roulette, data identifying the ball detecting element that detected the ball last before the ball fell from the rim; and an analyser operable to analyse the data to determine the distribution of the drop zone between the rim regions.

In an embodiment, the present invention provides a roulette wheel having a plurality of ball detecting elements spaced around the rim of the wheel and each operable to provide a ball detection signal in response to detection of the ball travelling through a corresponding region of the rim; a drop determiner operable to process the ball detection signals to identify, for each of a number of games of roulette, the ball detecting element that detected the ball last before the ball fell from the rim; and a memory operable to store, for each of a number of games of roulette, data identifying the ball detecting element that detected the ball last before the ball fell from the rim. The roulette wheel may also have an analyser operable to analyse the data to determine the distribution of the drop zone between the rim regions over a number of games.

This enables an operator to determine whether any drop zone bias is occurring and to take appropriate action. As another possibility, the roulette wheel may be have a levelling motor or motors that can be controlled to correct the levelling of the roulette wheel in response to detection of a drop zone bias. For example, the detection system may provide a signal to drive the levelling motor or motors to compensate for the detected drop zone bias.

The drop detector may be implemented by any one or more of a processor executing appropriate programming instructions or as a dedicated firmware and hardware.

DESCRIPTION OF THE DRAWINGS

Embodiments of the present invention will now be described by way of example with reference to the accompanying drawings, in which:

FIG. 5 shows an example of data logged in a memory of the data processing unit illustrated in FIG. 3;

SPECIFIC DESCRIPTION

Figure 1A:
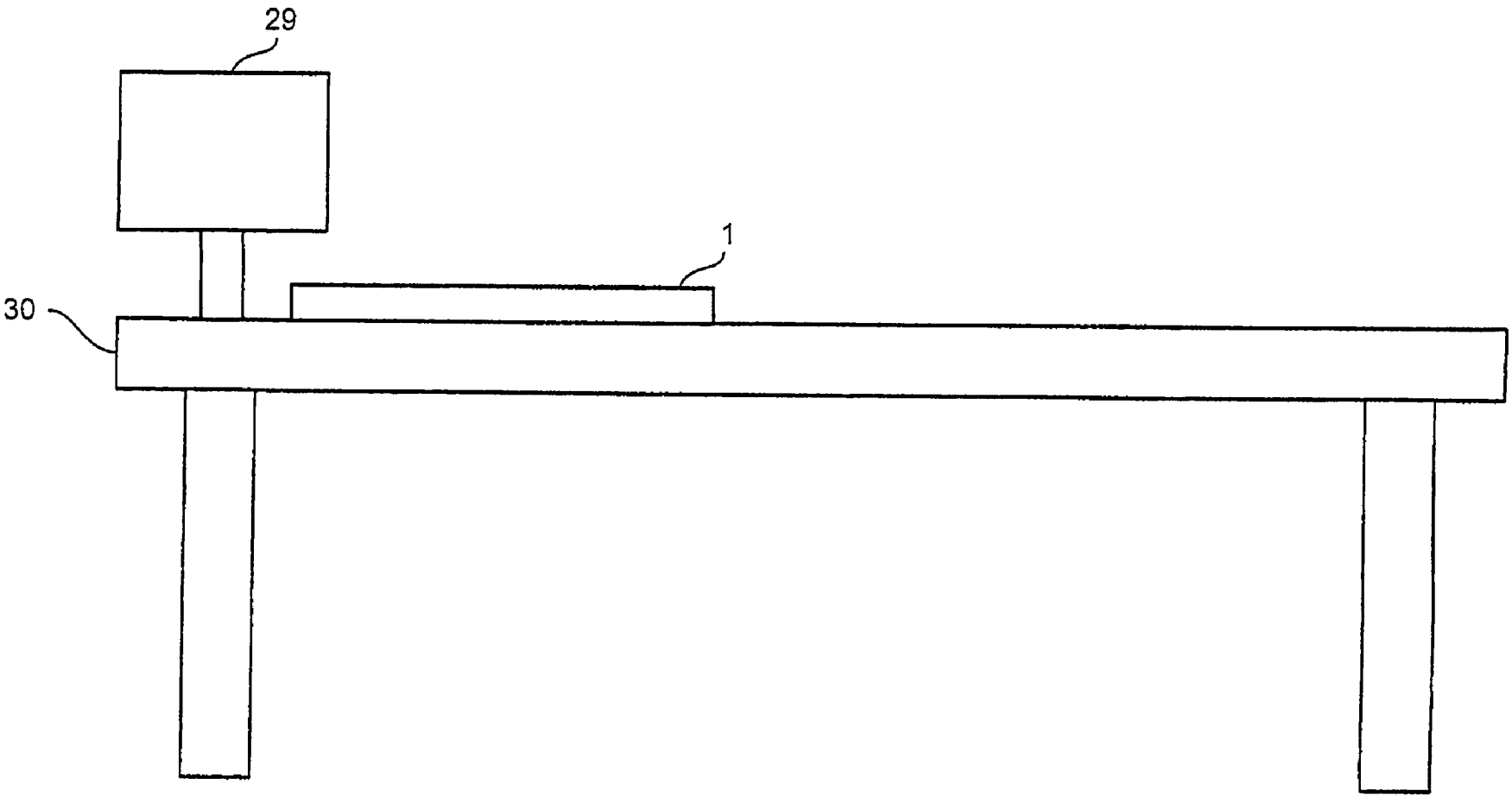
FIG. 1*a* shows a side view of a roulette table and associated display.
Figure 1B:
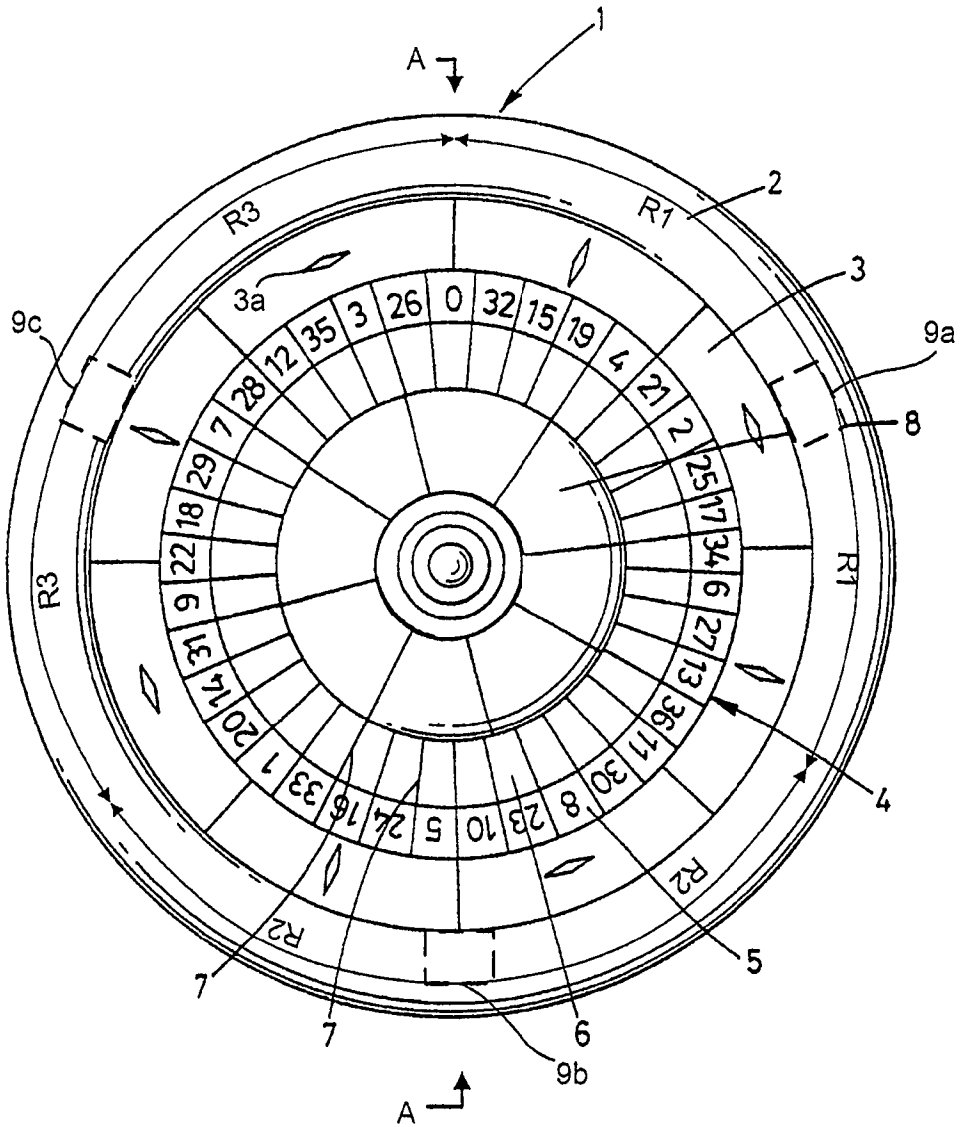
FIG. 1*b* shows a plan view of a roulette wheel embodying the present invention.

Referring now to the drawings, FIGS. 1*a* and 1*b* show, respectively, a side view of a roulette table 30 carrying a roulette wheel 1 and associated with a display 29 and a plan view of a roulette wheel 1 embodying the invention.

The roulette wheel 1 has a cylindrical support body 2 within which a rotatable pocket cylinder 4 is concentrically mounted so that a circular rim 3 of the cylindrical support body 2 extends around the rotatable pocket cylinder 4. The rim may have deflectors 3*a* for altering the course of the ball as it falls from the rim 3 during a play or game.

The rotatable pocket cylinder 4 has an outer numbers ring 5 and an inner ring of pockets 6 both concentric with the rotation axis of the rotatable pocket cylinder 4. Each pocket 6 is individually identified by the corresponding number of the numbers ring 5 and is isolated from its neighbouring pockets by upstanding separators 7, for example a starburst shape. As so far described, the roulette wheel is of conventional form.

The roulette wheel 1 differs from a conventional roulette wheel in that it includes a detection system for obtaining data relating to a play or game and for obtaining data relating to the roulette wheel as will now be described with the aid of FIGS. 2 and 3.

The detection system consists of a number of sensing units 9 spaced around the rim 3. In this embodiment, the roulette wheel 1 has three sensing units 9*a*, 9*b* and 9*c* evenly spaced (and so one hundred and twenty degrees apart) around the rim.

Figure 2:
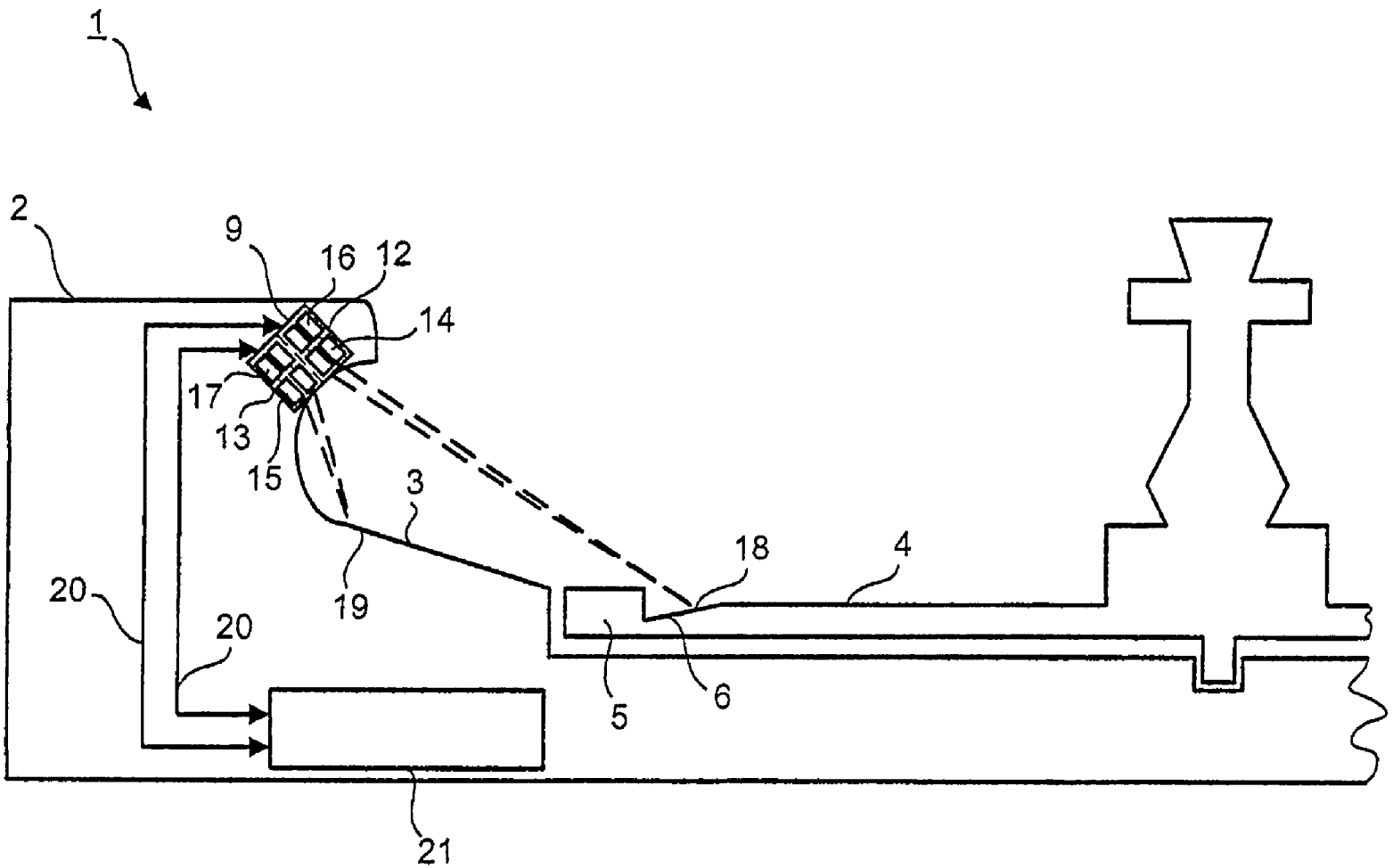
FIG. 2 shows a cross-sectional view taken along line A-A in FIG. 1.

Each sensing unit 9 has, as shown in FIG. 2, two sensors, a first, pocket sensor 12 for sensing a ball in a pocket of the rotatable pocket cylinder 4 and a second, rim sensor 13 for sensing a ball in the rim 3. Each of the sensors 12 and 13 has a light emitting device 14 (such as a light emitting diode (LED) or laser diode) for illuminating a target area of the pocket cylinder and rim, respectively, and a light detecting device 15 for detecting light reflected from the target area. The pocket and rim target areas 18 and 19 of one sensing unit 9 are illustrated diagrammatically in FIG. 2.

The light emitting devices 14 are driven by drive circuitry 16 to emit frequency modulated light at a particular wavelength or wavelength range, for example yellow light modulated at, for example, 125 Kilo Hertz while the light detecting devices are coupled to signal processing circuitry 17 for processing (for example by carrying out thresholding, filtering, amplifying and analogue to digital conversion) signals produced by the light detecting device 15 so that the signal is high when a ball is detected and is otherwise low. Further details of this modulated light technique can be found in European patent EP 757 582, the whole contents of which are hereby incorporated by reference.

The sensing units are, as shown in FIG. 2, coupled via connector cables 20 to a data processing unit 21.

Figure 3:
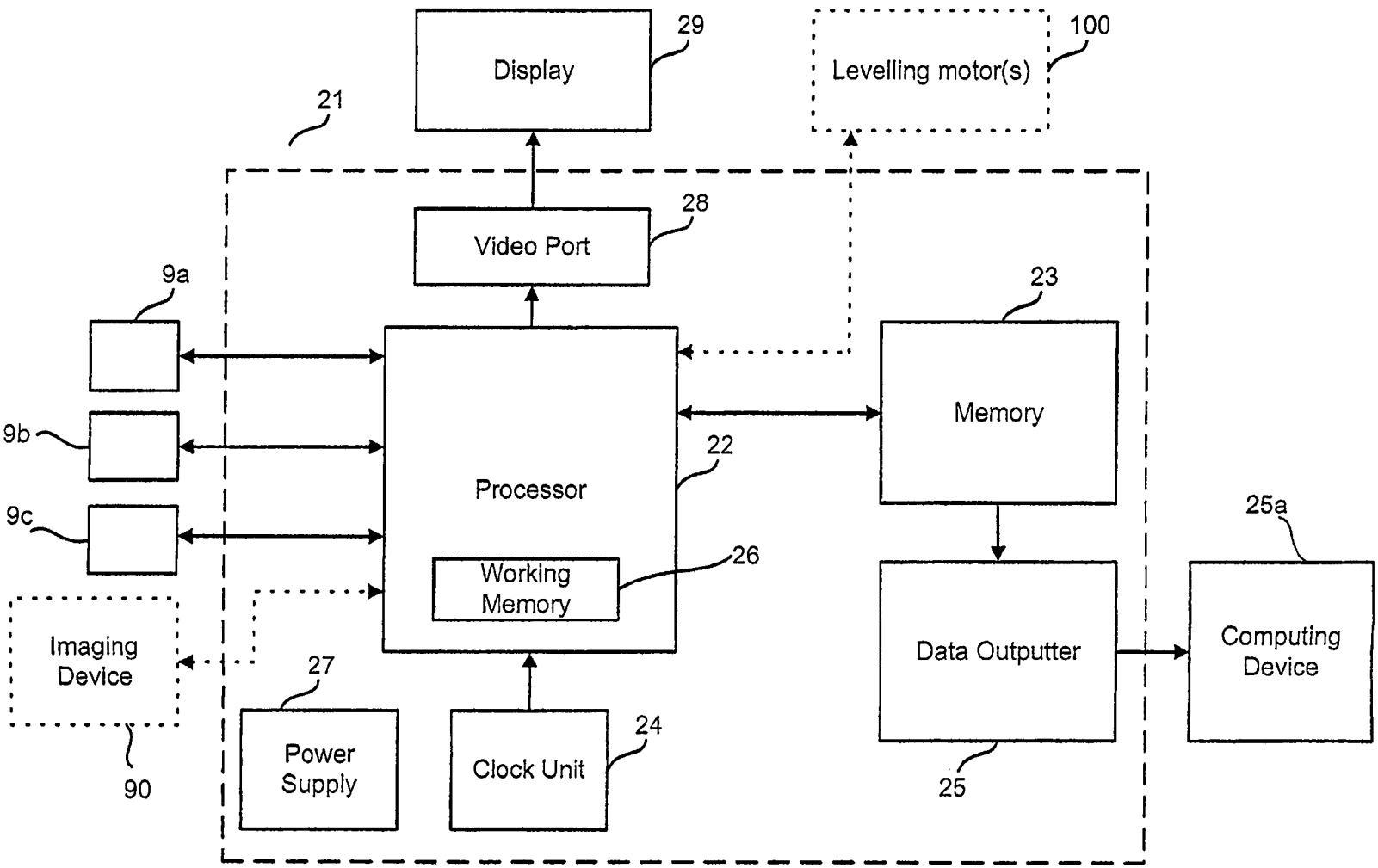
FIG. 3 shows a functional block diagram of a data processing unit illustrated in FIG. 2.

FIG. 3 shows a functional block diagram of the data processing unit 21. The data processing unit 21 has a processor 22 coupled via the cables 20 to each of the sensing units 9 for enabling the processor 22 to control the drive circuitry 16 of the pocket and rim sensors 12 and 13 and for enabling the processor to receive data from the signal processing circuitry 17 of the pocket and rim sensors 12 and 13.

The data processing unit 21 also has a memory 23, a clock unit 24 (which could be internal to the processor) and a data outputter 25. The memory may be provided by any suitable form of writable memory such as RAM or a non volatile memory such as programmable ROM or a reprogrammable ROM, for example an EEPROM, while the data outputter may be any suitable interface for enabling connection to a computing device 25*a* such as a personal digital assistant (PDA), laptop, personal computer and so on. In this example the interface is an RS485 to USB interface, although it will be appreciated that any standard data communications interface may be used and that it need not necessarily be a wired connection.

The processor 22 has a working memory 26 which is shown as being internal to the processor although it could be external or even part of the memory 23.

The data processing unit also has a video port 28 for connection to the display 29 shown in FIG. 1*a* and a power supply 27 (which may be a mains power supply or a battery power supply or a battery-backed-up mains power supply) for powering the data processing unit and the sensing units. For simplicity, the connections to the power supply 27 are not shown in FIG. 2.

In operation of the roulette wheel 1, the pocket cylinder is spun and a ball is set in motion so that it travels around the rim in either the clockwise or counter-clockwise direction. The ball is subjected to forces (for example due to gravity, friction, blasts of air, collisions with decorative features or even movement of the table as a whole) that slow it down until it can no longer travel along the rim and drops into the pocket cylinder, coming to rest in one of the pockets.

As the forces acting on the ball cause it to slow down, gravity overcomes the centrifugal force and the ball falls down the rim 3 and over the number ring 5. The ball may then bounce off one or more obstacles such as one or more separators 7 or the dome 8, before eventually coming to rest in one of the pockets 6, which becomes the winning pocket.

The detection system provides game data and roulette wheel data for each game or play. In this example, the detection system is activated by the connection of the power supply 27 before the first play of the day.

Each sensing unit 9 has, as mentioned above, a pocket sensor 12 and a rim sensor 13 with the target sensing area (or field of view) of the rim sensor 13 being a part 19 of the rim immediately below the rim sensor and the target sensing area (or field of view) of the pocket sensor 12 being a part 18 of the numbers ring and pocket ring of the rotatable pocket cylinder 4.

Because of the colour contrast between the ball and rim (generally the rim is darker in colour and the ball is lighter in colour) as the ball passes a rim sensor 13, the output of the corresponding light detecting device 15 changes and the rim sensor 13 provides to the data processing unit 11 a signal indicative of the presence of a ball.

The rim sensors 13 are arranged to detect different parts of the rim 3 and therefore only one of the rim sensor 13 will see the ball at any point in time. As the ball travels around the rim 3, successive ones of the rim sensors 13 provide signals indicative of presence of the ball, with the order in which the rim sensors 13 detect the presence of the ball indicating the direction of rotation and the time between detections providing velocity information.

Figure 4:
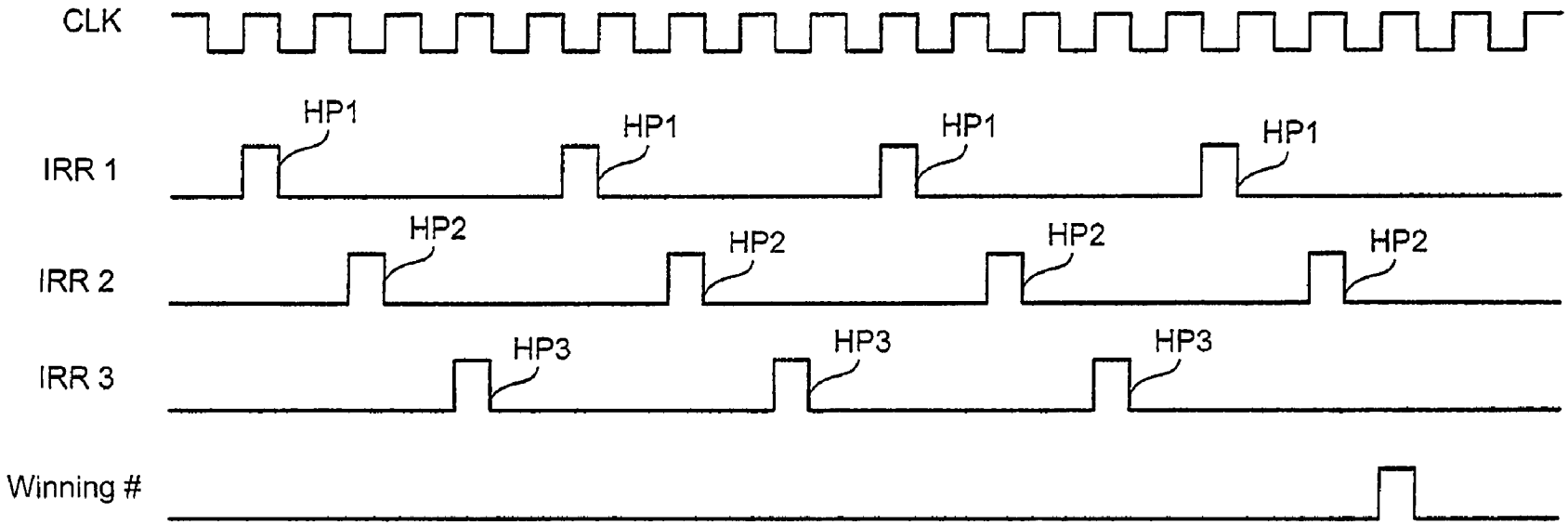
FIG. 4 shows a timing diagram for illustrating operation of the data processing unit illustrated in FIG. 3.

FIG. 4 shows a timing chart indicating the clock signal CLK output by the clock unit 24 and signals IRR1, IRR2 and IRR 3 provided by the rim sensors 13*a*, 13*b* and 13*c*, respectively. In this example, the ball is detected by the first rim sensor 13*a*, the second rim sensor 13*b* and the third rim sensor 13*c* before it is again detected by the first rim sensor 13*a* and so the processor 22 can determine that the rotation is in the clockwise (CW) direction. Of course, if the ball is spun in a counter-clockwise (CCW) direction, the ball will be detected by the third rim sensor 13*c*, second rim sensor 13*b*, first rim sensor 13*a* before being re-detected by the third rim sensor 13*c*. The processor writes the direction of rotation, CCW or CW, for that game into the memory 23.

The data processing unit 21 can also determine, using the clock signal CLK and the time between the ball detections by the rim sensors 13, the speed of the ball as it moves along the rim. When the speed drops below a certain speed indicative of the fact that the ball is about to fall from the rim, the processor 22 generates a "no more bets" signal which is supplied via a video output port 28 to the display 29 above the table 30.

Each pocket sensor 12 is arranged to detect the presence of the ball in the pocket ring 6. The method of generating the "no more bets signal" and detecting the ball in a pocket is described in European patent EP 0 757 582.

In addition to determining the ball speed and winning number, the data processing unit 21 is arranged to determine, for each game, the region of the rim 3 from which the ball falls, hereinafter referred to as the drop zone.

As mentioned above, as the ball travels round the rim 3, the processor 22 receives ball detection signals IRR1, IRR2, IRR3 from each of the rim sensors 9 in turn. Each ball detection signal produces a respective high pulse HP1, HP2, HP3 when it detects the presence of the ball and when the processor 22 receives a pulse HP1, HP2 or HP3, it records the identity of the rim sensor 13 that produced the pulse in its working memory 26.

When the processor 22 has received a signal from a pocket sensor 12 indicating that ball has fallen from the rim and come to rest in a pocket, the processor 22 outputs the winning number to the display 29 and writes the winning number for that game into the memory 23. After identification of the winning number, the processor 22 determines which of the rim sensors 13 detected the ball last (that is the last rim ball detection before the ball dropped from the rim) and writes the identity of the rim region corresponding to that rim sensor 13 into the memory 23. In the example game illustrated by FIG. 4, the last ball detection pulse HP2 was provided by rim sensor 13*b*.

FIG. 5 shows an example of data logged in the memory 23 for a large set of games. In this embodiment, the memory 23 is sufficiently large to store approximately six years of game data. The first field 31 in FIG. 5 contains a unique game number. The next field 32 is configured to store the identity of the rim region corresponding to last rim sensor passed by the ball before it fell from the rim. Subsequent fields 33 and 34 are configured to store other game statistics, as shown the winning number and the rotation direction of the roulette cylinder. The memory may also be configured to store the average rotation speed of the cylinder, the average rotation speed of the ball in the rim etc.

The data outputter 25 of the data processing unit 21 allows an authorised operator to download the game data stored in the memory 23 into a computing device for analysis with, for example, a standard statistical analysis package such as Microsoft Excel (Registered Trade Mark) to determine the relative frequency with which the drop zone is in each different rim region.

Figure 6A:
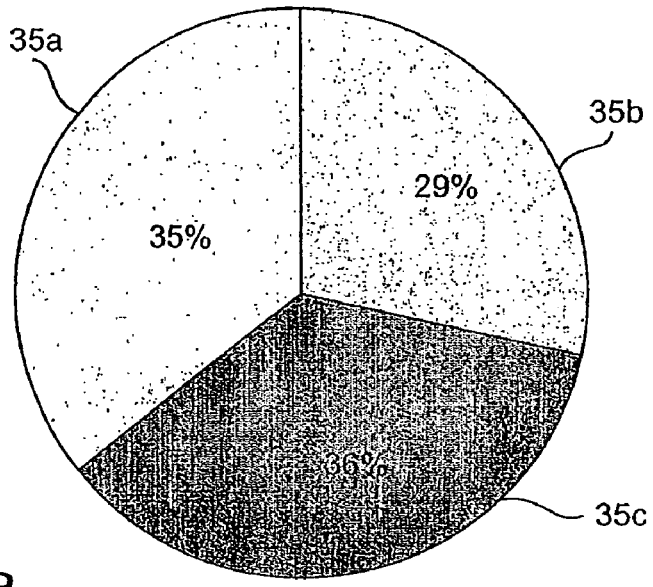
FIG. 6 shows the results of an analysis of data stored in the memory illustrated in FIG. 5.
Figure 6B:
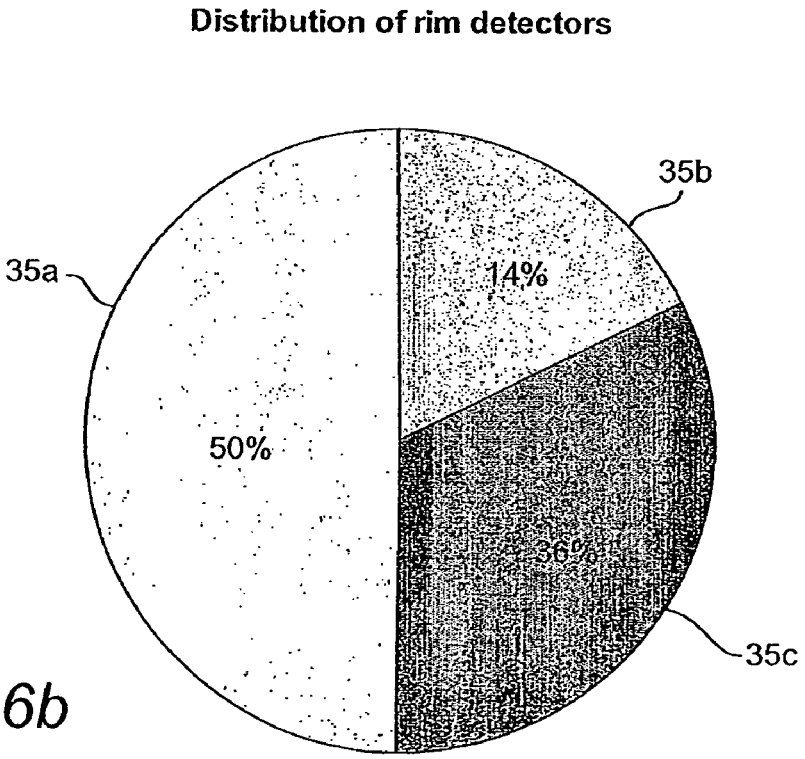

In this example, as shown in FIGS. 6*a* and 6*b*, the data is analysed to create a pie chart with sectors 35*a*, 35*b* and 35*c* indicating the frequency or number of times the drop zone was in the corresponding rim region R1, R2 and R3 (see FIG. 2). FIG. 6*a* shows an example where the drop zone has occurred equally in all three rim regions while FIG. 6*b* shows an example where the drop zone has occurred far more frequently in rim region R1. This information shows the authorised operator whether the roulette wheel has a bias to any of the rim regions, which may indicate that the roulette wheel is not level (horizontal). The authorised operator can then check the roulette wheel for any bias, for example tilting (either as a result of an error in the levelling of the roulette wheel or table, temperature drift, external forces or of a player deliberately or accidentally leaning on the roulette table) or other mis-operating condition such as, for example: a faulty sensor; operator error (for example due to the operator consistently introducing the ball to the rim at the same place and/or with the same speed and/or in the same direction); the presence of dirt on the rim; and/or air currents from ambient sources such as air conditioning or heating systems.

The detection system described above allows an authorised operator to determine whether a roulette wheel has any drop zone bias, for example due to incorrect levelling of the roulette wheel itself or of the casino table or due to actions of a player or dealer.

Alternatives

As described above, three sensing units were used, dividing the roulette wheel into three possible drop zone regions, each a sector covering a 120 degree angle. Of course, a different number of rim sensors could be used from a minimum of two up to a case where a sensor is provided for each pocket on the roulette wheel, e.g. thirty seven for a conventional "single zero" roulette wheel. The accuracy of the system in detecting the orientation of the table will increase as the number of rim sensors is increased, however the cost will also increase.

Figure 7:
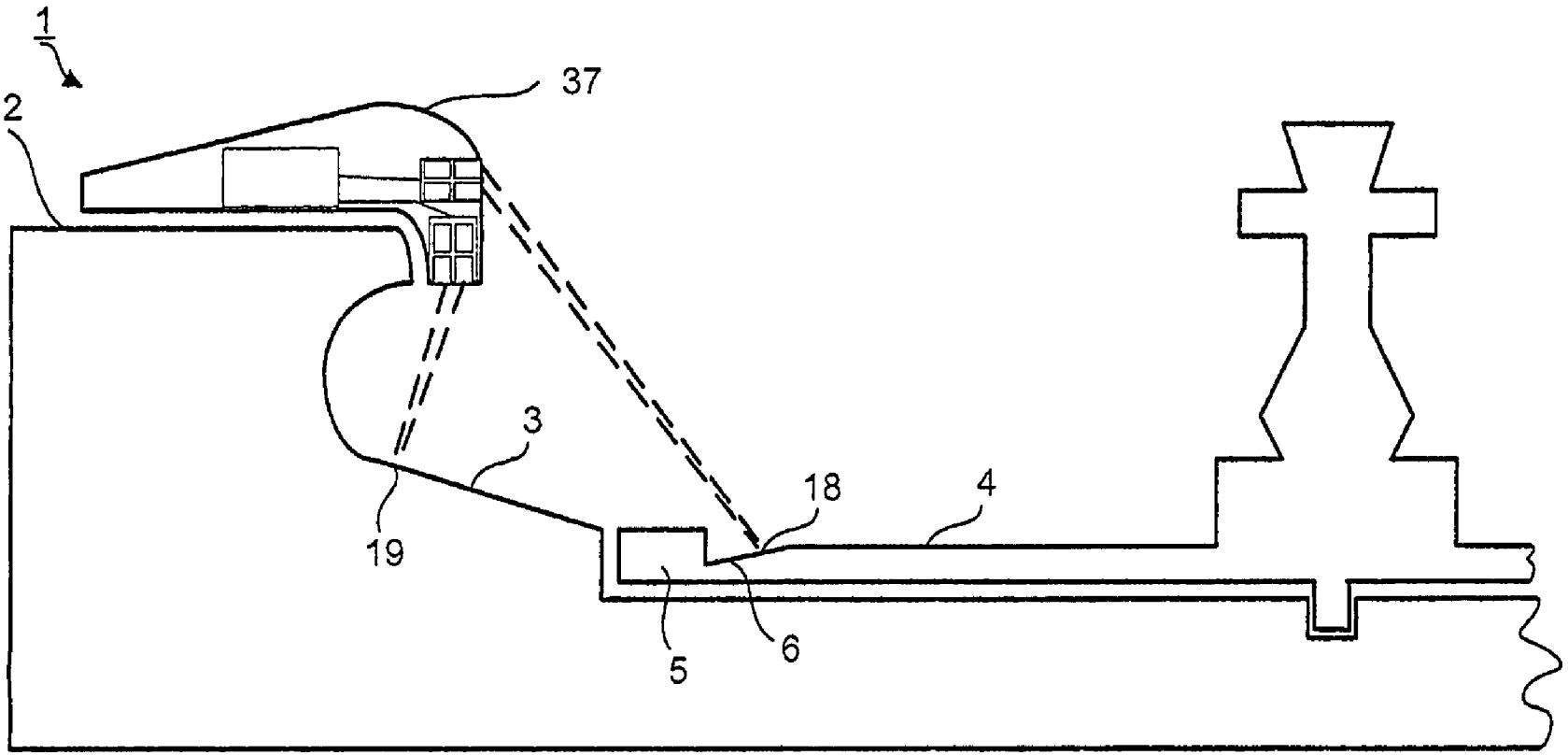
FIG. 7 shows a cross-sectional view similar to FIG. 2 of another roulette wheel embodying the invention.

As described above, the sensors are mounted in the rim of the roulette wheel. As an alternative, all or some of the sensors could be mounted on the rim of the roulette wheel. As shown in FIG. 7, as another possibility, the sensing unit and the data processing unit may be arranged in a housing 37 mountable on the rim of the roulette wheel. Such a sensor housing is described in European patent EP 0 757 582. This arrangement is advantageous in that a conventional roulette table can be retrofitted.

Of course, the housing does not need to contain all of the sensors. As another possibility, some sensors may be integrated into the rim and other sensors contained in the housing 37. For example, the rim sensors may be integrated in the rim and the pocket sensors provided in the housing.

As described above, the rim sensors detect the ball using modulated light. As described above, frequency modulation is used. Frequencies other than that mentioned above may be used, for example 225 kilohertz. The frequency should be selected to enable the modulated light to be distinguishable from ambient light conditions such as the effect of mains powered lighting. It may however also be possible to use other modulation techniques such as amplitude or phase modulation. Also, where differentiation of the reflected light from background light is not an issue, it may be possible to use an un-modulated light source. As described above, yellow light is used. However any wavelength or range of wavelengths in the visible, infra red or ultra violet part of the spectrum may be used provided that the ball can be differentiated from the rim and the pockets. Different types of light source may be used for the pocket and rim sensors. As another possibility, the detection of the ball could be performed using video cameras and frame analysis as described in EP 1 250 688. For example, a web cam could be used to capture frame data to allow remote monitoring. In this case, it may be possible to replace the sensing units 9*a* to 9*c* with a single imaging device 90

(shown in dashed lines in FIG. 3) such as a video camera mounted above the roulette wheel to obtain a succession of images or frames of at least the rim region of the roulette wheel as the ball is travelling in the rim and to analyse the obtained images to determine the image of rim in which the ball is last in the rim and to determine from that image the region of the rim from which the ball fell from the rim. As another possibility, a number of imaging devices may be used.

As described above, the game data is downloaded from the memory of the data processing unit and analysed on a remote computer. As another possibility or additionally, the analysis could be performed by the processor 22 and the results either stored for later display or transferred for display in real-time to a security remote monitor. If the processor is not capable of running a relatively sophisticated analysis software, the processor may simply provide, for each rim sensor, the number of times the corresponding rim region contained the drop zone.

As described above, the processor logged the identity of the rim sensor which last detected the ball in the rim when the "winning number signal" was received. As an alternative, the processor may log the identity of the rim sensor which last detected the ball in the rim when a predetermined time has elapsed since that detection.

As described above, the number of pocket sensors is the same as the number or rim sensors, this need not necessarily be the case and there may for example be only one or at most two pocket sensors.

As described above, the memory 23 is provided by RAM non volatile memory such as programmable ROM or a reprogrammable ROM, for example an EEPROM. As another possibility, the memory 23 and data outputter may be replaced by a removable memory such as a flash memory card, removing the need for a connection to a computing device.

As described above, the detection system is activated before the first play or game. As another possibility, the detection system may be activated each time the rotatable pocket cylinder is spun. It may be possible to automate this.

As described above, the sensor outputs are supplied in parallel to the processor 22. As another possibility, the outputs of the sensing units may be multiplexed for supply to the processor 22.

As described above, the drop zone distribution is shown as a pie chart. However, any suitable visual representation may used, for example a histogram, radar chart or any other form of pictorial data representation. As another possibility, a text or audio file representing the drop zone distribution could be output for remote analysis. As another possibility, a textual message or alarm sound could be output when bias is detected.

In the above embodiment, the roulette game was conducted by a croupier. However, as another possibility, an automated wheel could be used. Such a wheel has a motor for spinning the roulette wheel to force the ball up into in the rim, and an automatic system for determining when the ball is about to drop from the rim in order to issue a "no more bets" message and for identifying the number associated with the winning pocket.

As described above, the operator takes appropriate action in response to detection of a drop zone bias. As another possibility, the roulette wheel may be have a levelling motor or motors 100 (shown in dashed lines in FIG. 3) that can be driven by the processor 22 (via appropriate interfaces, not shown) to correct the levelling of the roulette wheel in response to detection of a drop zone bias to compensate automatically for a detected drop zone bias.

The invention claimed is:

1. A method of detecting drop zone bias in a roulette wheel having a continuous circular rim around which a ball can travel, the method comprising the steps of:

detecting by at least one imaging device the ball as the ball travels round the rim, providing a drop determiner operable for each of a number of games of roulette for determining a region of the rim from which the ball fell from the rim; a memory configured to store data representing the region of the rim from which the ball fell from the rim, for a number of games; and the drop determiner determining from the data stored in the memory whether or not there is a drop zone bias in the determined region.

2. A method according to claim 1, wherein the step of detecting the ball as the ball travels round the rim comprises providing a plurality of ball detecting elements spaced around the rim so that each ball detecting element generates a ball detection signal as the ball travels through a region of the rim corresponding to that ball detecting element, and the step of determining the region of the rim from which the ball fell from the rim comprises determining from the ball detection signals the ball detecting element passed last by the ball rim before the ball fell from the rim.

3. A method according to claim 1, wherein at least three ball detecting elements are provided for detecting the presence of a ball in the rim.

4. A method according to claim 3, wherein the ball detecting elements comprise modulated light sensors.

5. A method according to claim 3, further comprising the step of only storing the identity of the final ball detecting element passed by the ball in the rim.

6. A method according to claim 1, wherein the step of detecting the ball as the ball travels round the rim comprises providing at least one imaging device to provide images of at least the rim of the roulette wheel, and the step of determining the region of the rim from which the ball fell from the rim comprises determining from the image last showing the ball in the rim, the region of the rim from which the ball fell from the rim.

7. A method according to claim 1, further comprising determining at least one of the speed and direction of movement of the ball as it travels along the rim.

8. A method according to claim 1, further comprising providing at least one pocket detector that detects the presence of the ball in a pocket of the roulette wheel and determining the pocket number corresponding to the pocket containing the ball when the at least one pocket detector that detects the presence of the ball in a pocket.

9. A roulette wheel having a continuous circular rim;

a ball detector operable to detect a ball placed in the rim as the ball travels around the rim, a drop determiner operable for each of a number of games of roulette to determine a region of the rim from which the ball fell from the rim; and a store operable to memory for a number of games data representing the region of the rim from which the ball fell from the rim, the drop determiner determining from the data memory in the memory whether or not there is drop zone bias.

10. A roulette wheel according to claim 9, wherein the ball detector comprises a plurality of ball detecting elements spaced around the rim and each operable to generate a ball detection signal as the ball travels through a region of the rim corresponding to that ball detecting element, and the drop determiner is operable to determine the region of the rim from which the ball fell by determining from the ball detection signals the ball detecting element passed last by the ball before the ball fell from the rim.

11. A roulette wheel according to claim 10, wherein the number of ball detecting elements is at least three.

12. A roulette wheel according to claim 10, wherein at least one of the plurality of ball detecting elements is integrated in the rim of the roulette wheel.

13. A roulette wheel according to claim 10, wherein at least one of the plurality of ball detecting elements is provided in a housing mounted on the rim of the roulette wheel.

14. A roulette wheel according to claim 10, wherein the plurality of ball detecting elements are regularly spaced apart along the rim.

15. A roulette wheel according to claim 10, wherein the plurality of ball detecting elements comprise modulated light sensors.

16. A roulette wheel according to claim 9, wherein the drop determiner is operable to store only the identity of the last ball detecting element passed by a ball in the rim.

17. A roulette wheel according to claim 9, wherein the ball detector comprises at least one imaging device operable to provide images of at least the rim of the roulette wheel, and the drop determiner is operable to determine from the image last showing a ball in the rim the region of the rim from which the ball fell from the rim.

18. A roulette wheel according to claim 9, wherein the drop determiner is further operable to determine at least one of the speed and direction of movement of the ball as it travels along the rim.

19. A roulette wheel according to claim 9, further comprising at least one pocket detector to detect the ball in a pocket of the roulette wheel, and wherein the drop determiner is operable to determine the pocket number corresponding to the pocket containing the ball.

20. A detection system for detecting drop zone bias in a roulette wheel having a continuous circular rim and a ball detector operable to detect a ball as the ball travels around the rim, the detection system comprising: a ball detector operable to detect the ball placed on the rim as the ball travels around the rim;

a drop determiner operable for each of a number of games of roulette to determine a region of the rim from which the ball fell from the rim; a memory configured to store data representing the region of the rim from which the ball fell from the rim, for a number of games; and an analyser operable to analyse the data identifying for each of a number of games the region of the rim from which the ball fell from the rim to determine whether or not the roulette wheel has a drop zone bias.

21. A detection system according to claim 20, wherein, where the roulette wheel has a ball detector comprising a plurality of ball detecting elements spaced around the rim and each operable to generate a ball detection signal as the ball travels through a region of the rim corresponding to that ball detecting element, the drop determiner is operable to determine the region of the rim from which the ball fell by determining from the ball detection signals the ball detecting element passed last by the ball before the ball fell from the rim.

22. A detection system according to claim 21, wherein at least one of the plurality of ball detecting elements is provided in a housing mounted on the rim of the roulette wheel.

23. A detection system according to claim 21, wherein the plurality of ball detecting elements are regularly spaced apart along the rim.

24. A detection system according to claim 21, wherein the number of ball detecting elements is at least three.

25. A detection system according to claim 21, wherein the plurality of ball detecting elements comprise modulated light sensors.

26. A roulette wheel according to claim 20, wherein, where the roulette wheel has a ball detector comprising at least one imaging device to provide images of at least the rim of the roulette wheel, the drop determiner is operable to determine the region of the rim from which the ball fell from the rim from the image last showing the ball in the rim.

27. A detection system according to claim 20, further comprising the roulette wheel.

28. A detection system according to claim 27, wherein at least one of the plurality of ball detecting elements is integrated in the rim of the roulette wheel.

29. A detection system according to claim 20, wherein the drop determiner is further operable to determine at least one of the speed and direction of movement of the ball as it travels along the rim.

30. A detection system according to claim 20, further comprising at least one pocket detector to detect the ball in a pocket of the roulette wheel, and wherein the drop determiner is operable to determine the pocket number corresponding to the pocket containing the ball.

* * * * *